US008813282B2

(12) United States Patent
Roban

(10) Patent No.: US 8,813,282 B2
(45) Date of Patent: Aug. 26, 2014

(54) THERAPEUTIC PILLOW WITH HAND REST

(76) Inventor: Andres Roban, Brooklyn, NY (US)

( * ) Notice: Subject to any disclaimer, the term of this patent is extended or adjusted under 35 U.S.C. 154(b) by 0 days.

(21) Appl. No.: 13/806,295

(22) PCT Filed: Jun. 17, 2011

(86) PCT No.: PCT/US2011/040892

§ 371 (c)(1),
(2), (4) Date: Dec. 21, 2012

(87) PCT Pub. No.: WO2011/163078

PCT Pub. Date: Dec. 29, 2011

(65) Prior Publication Data

US 2013/0091632 A1 Apr. 18, 2013

Related U.S. Application Data

(60) Provisional application No. 61/358,860, filed on Jun. 25, 2010.

(51) Int. Cl.
*A47G 9/00* (2006.01)
*A47G 9/10* (2006.01)

(52) U.S. Cl.
USPC ..... 5/636; 5/623

(58) Field of Classification Search
USPC ..... 5/630, 632, 646, 636, 621–623
See application file for complete search history.

(56) References Cited

U.S. PATENT DOCUMENTS 2,782,427 A * 2/1957 Ericson ..... 5/632
3,382,510 A 5/1968 Robinson
4,118,813 A 10/1978 Armstrong
4,210,317 A * 7/1980 Spann et al. ..... 5/647
4,788,728 A 12/1988 Lake
5,214,814 A * 6/1993 Eremita et al. ..... 5/636
5,771,514 A * 6/1998 Wilhoit ..... 5/644
6,622,727 B2 9/2003 Perry
7,082,633 B1 * 8/2006 Maarbjerg ..... 5/636
7,434,281 B1 10/2008 Holliday et al.
7,578,015 B1 * 8/2009 Wilson et al. ..... 5/644
2006/0179572 A1 8/2006 Rubio
2009/0293885 A1 12/2009 Lee

FOREIGN PATENT DOCUMENTS

CA 2117701 3/1996

OTHER PUBLICATIONS

International Search Report mailed Oct. 28, 2011 in connection with Application No. PCT/US2011/040892.
Written Opinion mailed Oct. 28, 2011 in connection with Application No. PCT/US2011/040892.
European Search Report mailed Oct. 31, 2013 in connection with co-pending European Application No. 11798676.0-1653.

* cited by examiner

*Primary Examiner* — Fredrick Conley
(74) *Attorney, Agent, or Firm* — McCarter & English, LLP

(57) ABSTRACT

The disclosed embodiments relate generally to a therapeutic pillow, and more particularly the disclosed embodiments relate to a pillow designed to support the head and neck of a sleeper and provide facial protection against definition lines and wrinkles in any position during sleep. The neck and head support also is designed to aid in better respirations and breathing while sleeping on the pillow, and allow positioning and support of aroma therapy or any other type of therapy on the pillow while sleeping. The hand rest portion allows better positioning of the shoulder region and neck region for sleep and also provide support to the arm region to promote healing if the arm is injured.

11 Claims, 17 Drawing Sheets

THERAPEUTIC PILLOW WITH HAND REST

The present application claims priority under 35 U.S.C. §119(e) from Provisional Application No. 61/358,860 filed Jun. 25, 2010, which is herein incorporated by reference.

FIELD OF THE INVENTION

A therapeutic pillow is disclosed. More particularly the disclosed pillow provides for a hand rest, support for aroma therapy or other sensation type therapy, and other features designed to benefit a user while sleeping in any position.

BACKGROUND OF THE INVENTION

Many of today's therapeutic pillows purport to assist in some health benefit during sleep. A common health problem that exists is pain and tension in the head, neck and shoulders. This problem may arise in an otherwise healthy person due to improper support of the head, neck and shoulders during sleeping. Some therapeutic pillows provide support to the neck and head regions. However, these pillows lack the ability to provide for sleep in various positions such as the supine, lateral, or prone positions.

Additionally, these pillows lack a resting place for positioning of the hand that complicates any movement during the sleep cycle. Hand and arm positioning is important during sleep, as it affects the shoulder region's position during sleep. Improper shoulder positioning may add additional stress to the cervix region causing further distress. The pain and tension caused by poor sleep positioning may cause further problems associated with difficulties in resting, such as insomnia, restlessness, light sleep, and snoring.

It is previously known that the optimal position of the human cervix or neck area is known as the neutral position. This position corresponds substantially to the most anatomically natural position of the cervical spine of a person who is standing upright with correct posture. In the neutral position, the lordotic curve or inward curvature of the cervical spine is maintained such that the lowest degree of stress is placed on the cervical vertebrae and surrounding connective and other tissues, and the minimum amount of neck and back pain are maintained. When the cervix is in a suboptimal position, there is a potential for the circulation of blood and nutrients through the neck to be restricted due to stressed connective tissue and vessels. Additionally, suboptimal neck position can lay stress on the nerves in the neck and head causing neurological instability of the vasomotor and muscular mechanical reflexes, among other neurological problems. Suboptimal neck position may also constrict breathing, which can cause or exacerbate snoring, sleep apnea, and other breathing related disorders that affect resting persons.

In addition, aroma therapy or the like would be beneficial during the sleep cycle for various breathing disorders. Therapeutic pillows known in the art lack the ability to support aroma therapy or other such therapies. These prior art pillows also are known for lacking the ability to interchange and replace various aroma therapies on the same pillow in a convenient manner. Positioning of the aroma therapy in relation to a user's nostrils and mouth is important to the overall effectiveness of the aroma therapy.

Known therapeutic pillows are not designed to support a person's hand and arm positioning, which is important in all sleeping positions. Some known pillows are designed to support therapeutically the user's head and neck in the supine, but not the lateral position. Other known pillows are intended to support therapeutically the user's head and neck in either the supine or a lateral position depending on the initial position selected by the user, but not to support changes in position during the sleep cycle. Those pillows that purport to give support in various sleep positions lack the necessary hand support vital to correct positioning during sleep.

Facial lines during sleep are also a constant problem for currently known therapeutic pillows. These facial lines can promote wrinkles and other unwanted facial defects. Even with resilient material, known therapeutic pillows can promote such facial lines as the face of a user is placed against the pillow.

Thus, there still remains in the art a need for a therapeutic pillow device that provides a hand rest to support proper cervical spine and head positioning in various positions during sleep, and provides for the use of aroma therapy or the like during the sleep cycle. There is also a need in the art for a therapeutic pillow that reduces facial lines due to sleep on the pillow.

SUMMARY OF THE INVENTION

The present invention provides for a therapeutic pillow apparatus to position a user's head and neck in a supportive position. This supportive positioning is made regardless of whether the user is in the lateral, supine, or prone positioning during a sleep cycle. The pillow further provides for support of the hand and arm to further alleviate stress caused by improper positioning of the shoulder region during sleep. An area that supports aroma therapy is also provided. This area on the pillow allows easy access to the aroma therapy for changing the aroma therapy or other therapy such as but not limited to light therapy, sound therapy, motion therapy, vibration therapy and any combination thereof. In addition, the above supportive therapy area ensures proper positioning of the therapy, for example aroma therapy, in relation to the user. The pillow further includes a facial support area that reduces facial lines due to sleep on the pillow.

In one embodiment, a hand and arm rest is positioned on either side of the head rest. This embodiment allows for easy transition for the user from a lateral (side), supine (back), or prone (stomach) position to any other sleeping position. The hand rest ensures proper positioning of the shoulder to reduce any constriction to the cervical area. Aroma therapy or any other therapy, depending on the implementation, may or may not be placed in the hand rest areas adjacent to the user's nostrils and mouth. Aroma therapy may be disposed in the form of a holding pouch, beads, air-misting device such as a vaporizer, or any other such delivery means.

In another embodiment, the arm and hand rest is placed near the center of the therapeutic pillow. In this embodiment the head is placed on either side of the hand and arm support rest. Again, aroma therapy or any other therapy may be disposed in the hand and arm rest areas as recited above in the previous embodiment.

In still another embodiment, the head portion of the pillow is recessed near the center of the pillow. The arm and hand rests are disposed on either side of the head rest. Again, aroma therapy can be disposed in the arm and hand rest areas depending on the implementation. A facial ridge may be formed about the head recess to provide support on the underlying cheek section of the face while the user is in lateral positions.

In all the above embodiments, a facial ridge may be included in the therapeutic pillow to reduce the potential of facial lines as the user of the pillow is asleep. The facial ridge provides support to the cheek area thereby avoiding the face from crushing or wrinkling due to the weight of the head on the pillow. The hand rest can also be utilized to assist in the healing process of any injury to the hand or arm areas. The hand rest provides support for these and surrounding areas white the user is sleeping, thereby allowing better sleep without the possibility of further injury during sleep.

The foregoing objects are achieved and other features and advantages of the present invention will become more apparent in light of the following detailed description of exemplary embodiments thereof, as illustrated in the accompanying drawings.

BRIEF DESCRIPTION OF THE DRAWINGS

In the drawings, wherein similar reference characters denote similar elements throughout the several views.

DETAILED DESCRIPTION

The invention will now be described in detail with reference to the accompanying drawings. The present invention relates to a therapeutic non-conventional pillow having curves and other ergonomic shapes at strategic locations designed to assist in breathing better, to relieve definition/smile lines and to aid in relief of back pain. The pillow can be used for side sleepers, stomach sleepers, back sleepers and other forms of sleeping patterns. This pillow is designed in a way that while sleeping on your side, for example, the curves cradle your face and head while not crushing your face like regular pillows so as to resist definition lines being formed.

In one embodiment, the pillow has grooves in the middle and on both ends that serve as a hand-rest. The hand-rest assists in posturing the user's shoulder section to provide the proper positioning during the sleep cycle, The hand-rest sections can also be used for Aromatherapy treatments while the user is asleep. Aromatherapy can be in the form, but is not limited to, beads, potpourris, dried flowers, herbs, or spices, incense, and any combination thereof. There are curves on the base of the pillow so that you can fit your shoulder if you are sleeping on your sides, stomach, back or other sleeping patterns.

This invention, depending on the embodiment, comes equipped with covering for the pillow. The covering is for the protection of the pillow but may or may not be for sleeping. Pillow slips may be utilized to sleep on that are specially designed to place over the covering and the pillow.

In another embodiment, the pillows are made specifically for side sleepers or for restless sleepers (side sleepers, back sleepers, stomach sleepers, and those with different sleeping patterns). As illustrated in FIG. 1, the head of a user is curved up in the direction of the pillow 100 helping relieve a crushing effect caused by using regular pillows. The user's definition/smile lines are free from the crushing effect which could enhances wrinkles. The upward curve 150 of pillow 100 also helps users of this pillow to breathe better as the air passage has no interruption from the bending of one's neck while sleeping. The design of the pillow forces users of this pillow to position their neck and head to comfortably stretch, which aids in better breathing. The pillow also helps with back aches. Because of the pillow's design, side sleepers will enjoy sleeping on this pillow while having their back align in a straight and comfortable position.

Figure 5:
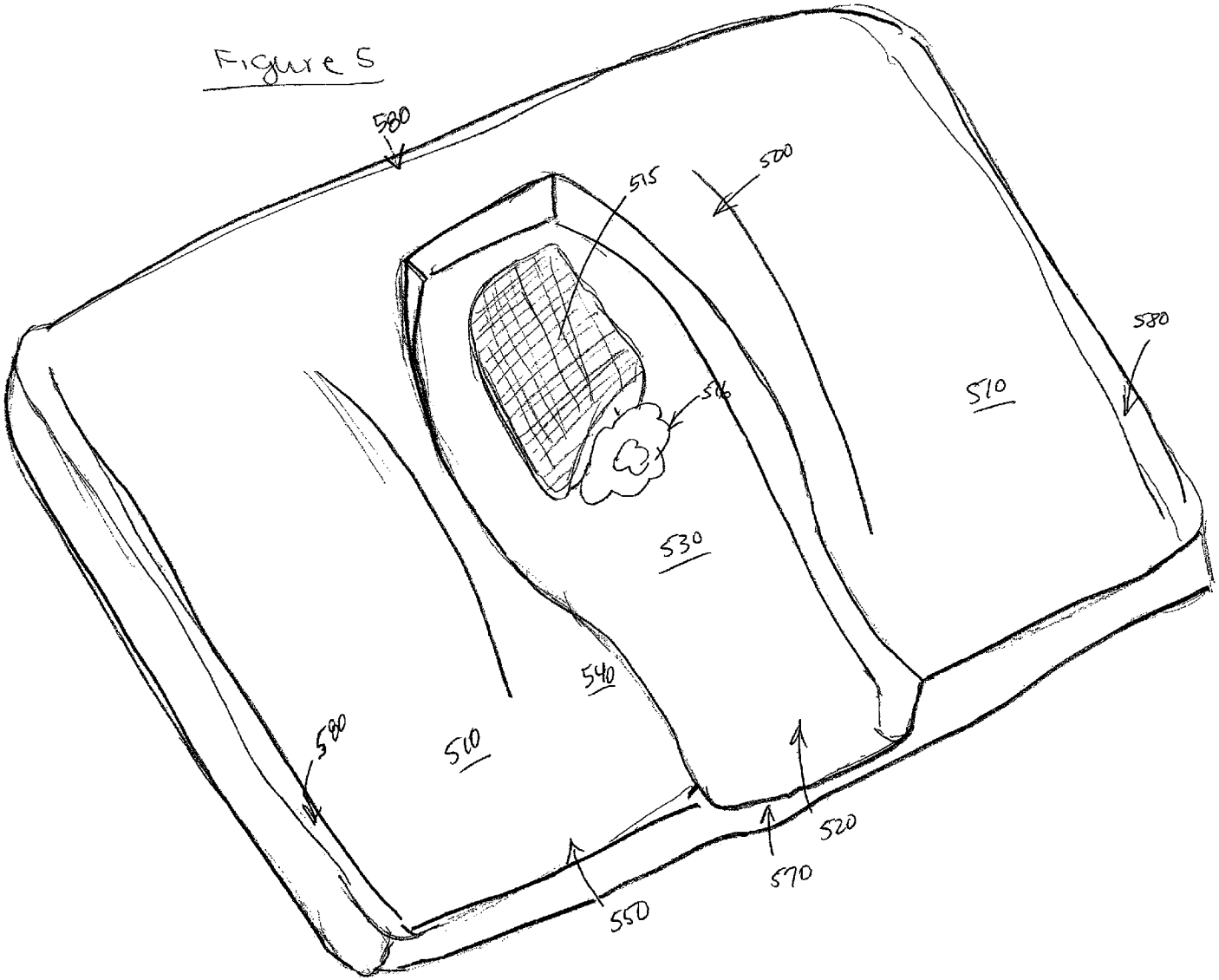
FIG. 5 shows a perspective view of the embodiment of FIG. 3 utilizing a slip cover and one embodiment of an aroma therapy device.

A Hand Rest/Aromatherapy Center is disposed with the therapeutic pillow to give users of this pillow multifunctional ways to use this pillow. An example of this embodiment is shown in FIG. 5. The user can sleep on their sides and use the center as a hand rest or place aromatherapy beads, potpourris or the like in a position adjacent to the nostrils of the user to feel even more rejuvenated while sleeping on the pillow.

Figure 2:
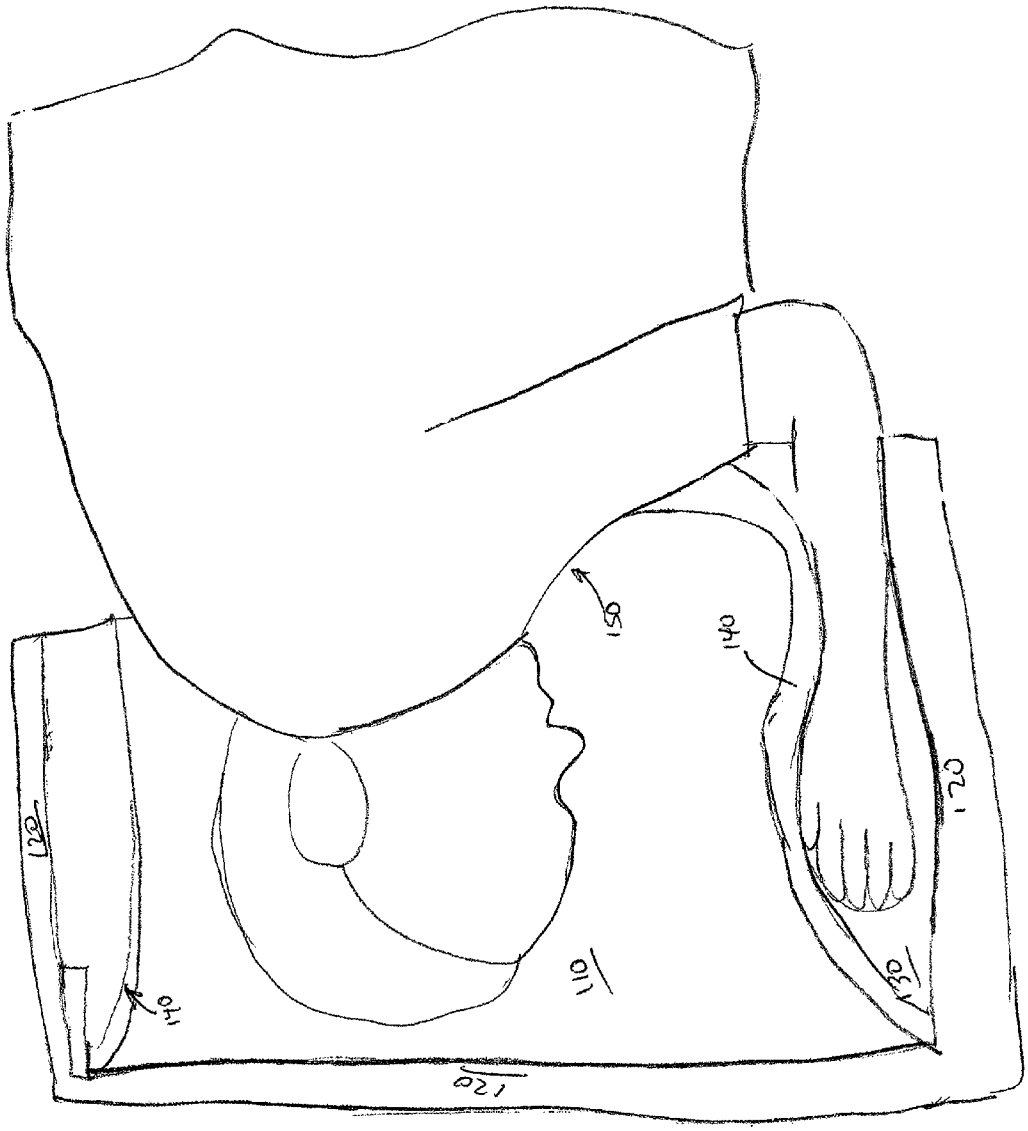
FIG. 2 shows a top view of FIG. 1A.
Figure 3:
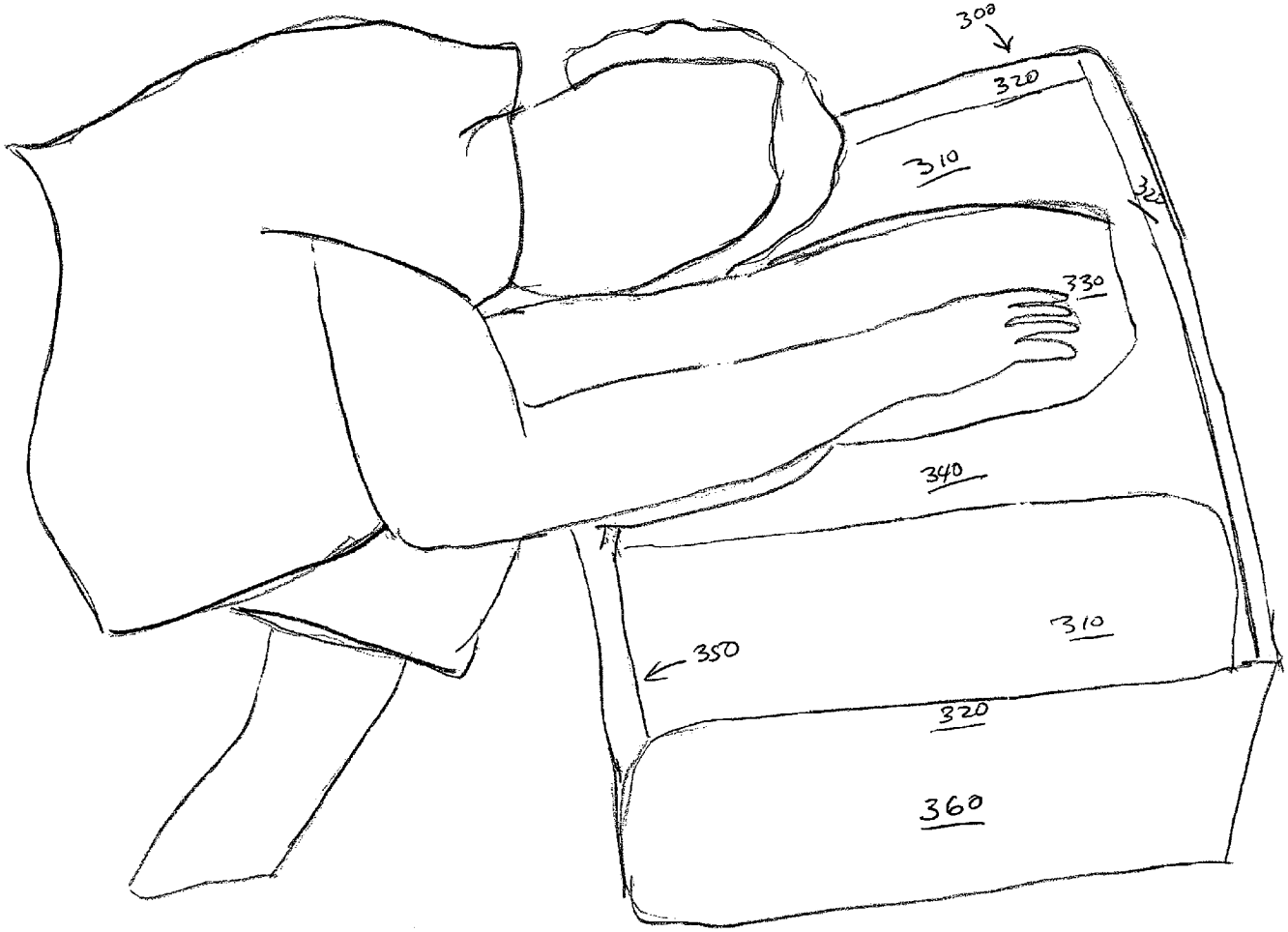
FIG. 3 shows another embodiment side view illustrating lateral use of the therapeutic pillow having a single hand rest.
Figure 4:
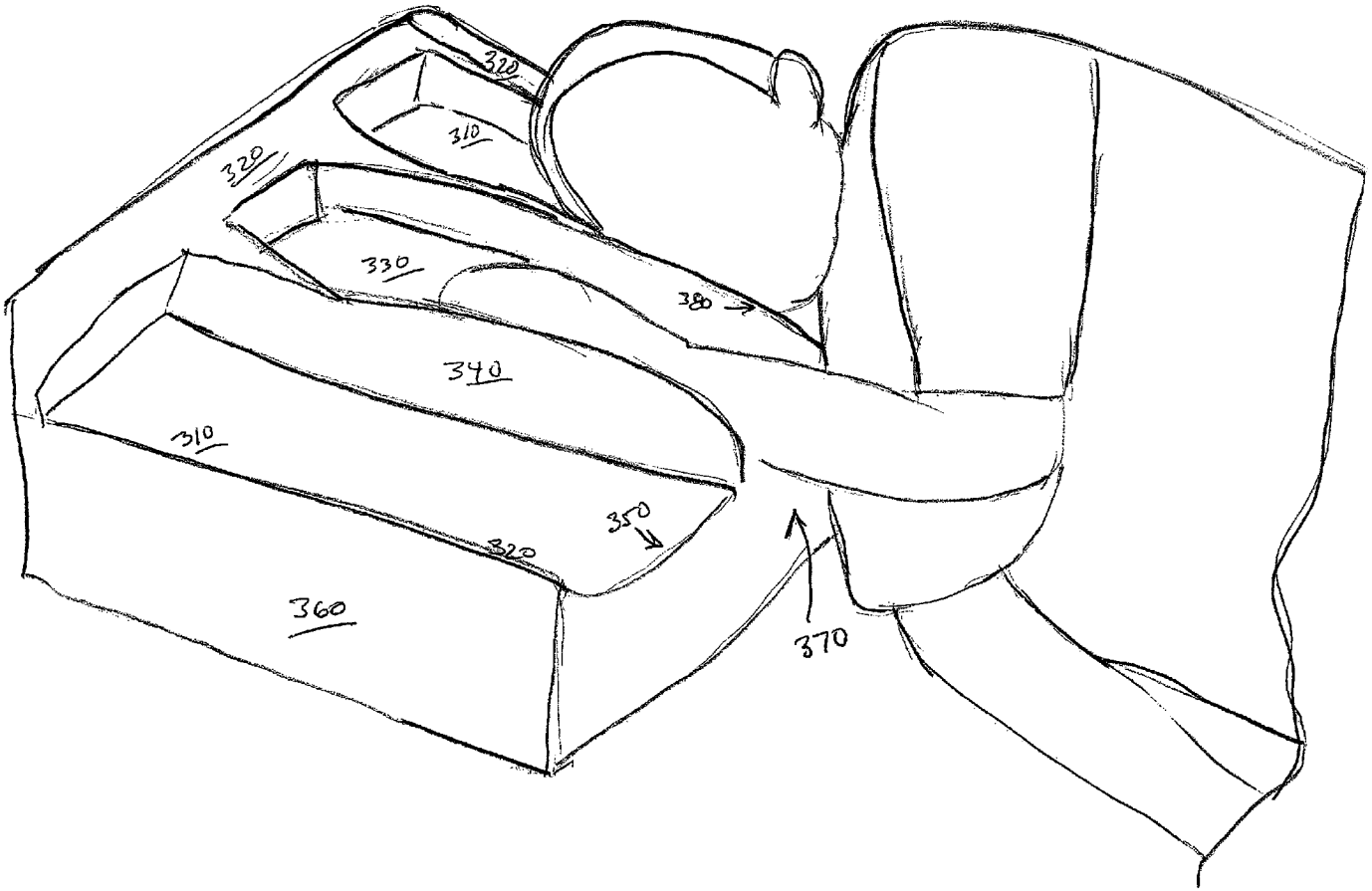
FIG. 4 shows an opposite side view of FIG. 3.

FIGS. 2-4 show side views and an aerial view of a user sleeping on the pillow. The side view illustrates again that this pillow also allows for helping relieve the crushing effect caused by using regular pillows. The user's definition/smile lines are free from the crushing effect which enhances wrinkles. The slightly upward curves on both sides of ridge 140 also help users of this pillow to breathe better as the air passage has no interruption from the bending of one's neck which sleeping. The pillow forces users to position their neck and head to comfortably stretch aiding in better breathing. This is done in part through incline 150. Shoulder region 160 also assists in the positioning as well as incline 170 of hand rest area 130. The pillow also assists in preventing back aches. Because of the pillow's design, side sleepers will enjoy sleeping on this pillow while having their back align in a straight and comfortable position. The pillow is dimensioned and shaped so that the head rests in an alignment position with the rest of the user's body. A conventional pillow results in a user's head being tilted downward when sleeping on one's side. The therapeutic pillow, however, has a head rest section 110 with incline 150 and shoulder curve 160 to align the user's head in a parallel position with the user's spine such that the cervical area is in alignment with the rest of the user's spine.

Depending on the embodiment, there may be multiple grooves or hand rests on the therapeutic pillow. For example, FIG. 1B is an illustration of a therapeutic pillow having two grooves on either end of the pillow. These grooves may also contain the Hand Rest/Aromatherapy near ridge or ridges 190.

The aroma therapy may be securely placed in groove 130 at a position near ridge 190 for maximum effect to the user. The hand rest gives users of this pillow multifunctional ways to use this pillow. The users can sleep, placing their hand in the hand rest or to place aromatherapy beads to feel even more rejuvenated while sleeping on the pillow.

With the multiple groove or multiple hand rest embodiment, the aroma therapy may also be placed in the hand rest behind the user while the user has his or her hand in the other hand rest in front of the user's face. In this embodiment, the user is prevented from being overwhelmed with the aroma therapy while still benefiting from the therapy behind the user.

It is within the scope of the invention for the pillow embodiments to be with or without an aroma therapy means. In another embodiment, the aroma therapy means may be substituted with a sound therapy means such as by a tape recording, ultrasound, infrasound, vibrations, motion, or the like. In addition the aroma therapy may be substituted with some form of light therapy. All these therapies articulated in this paragraph may also be used together in a any combination, singularly, or used all together to maximize therapy on many senses. In addition, the therapy center may not be used at all depending on the needs of the user.

Figure 1A:
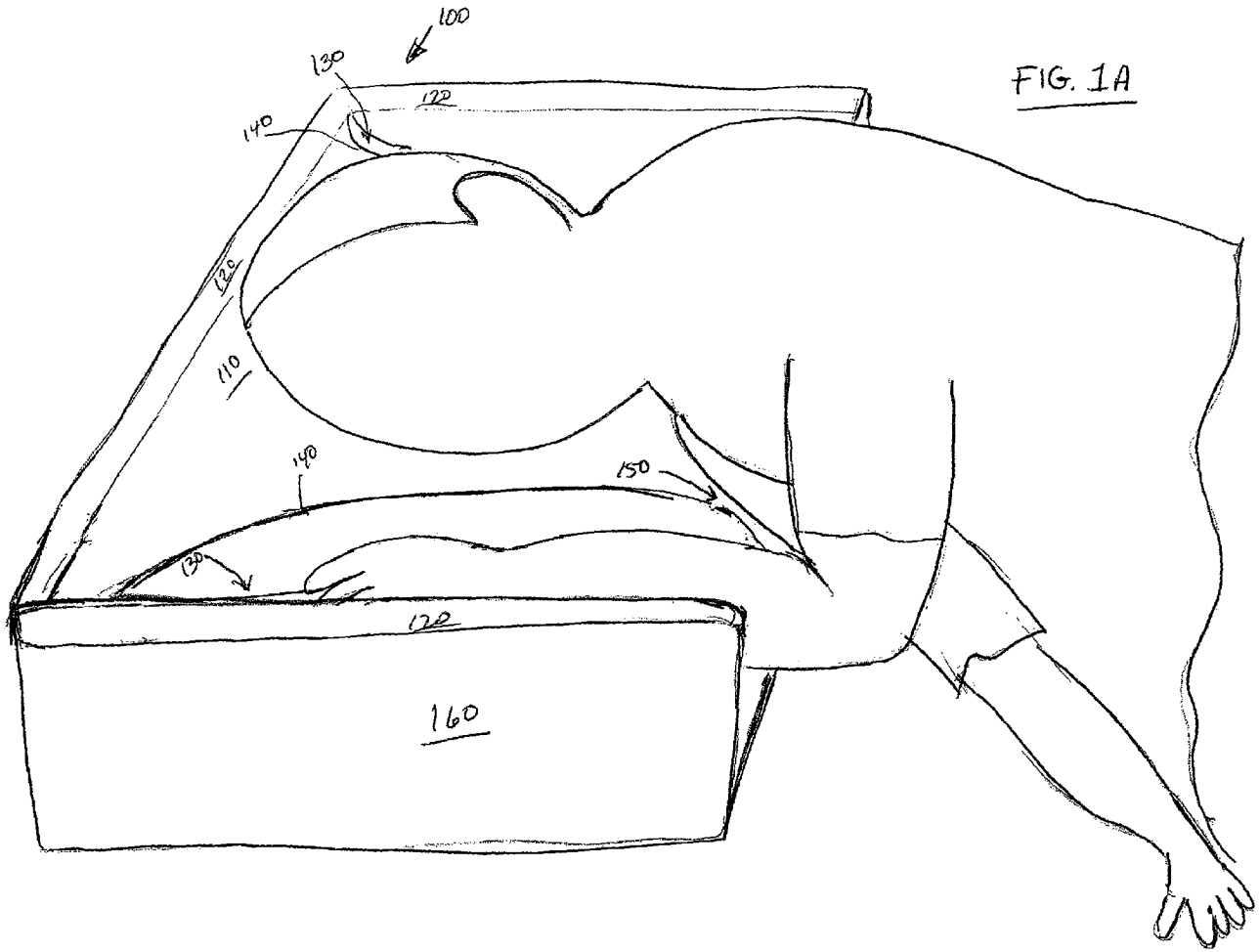
FIG. 1A shows a side view of one embodiment illustrating lateral use of the therapeutic pillow having multiple hand rests.
Figure 1B:
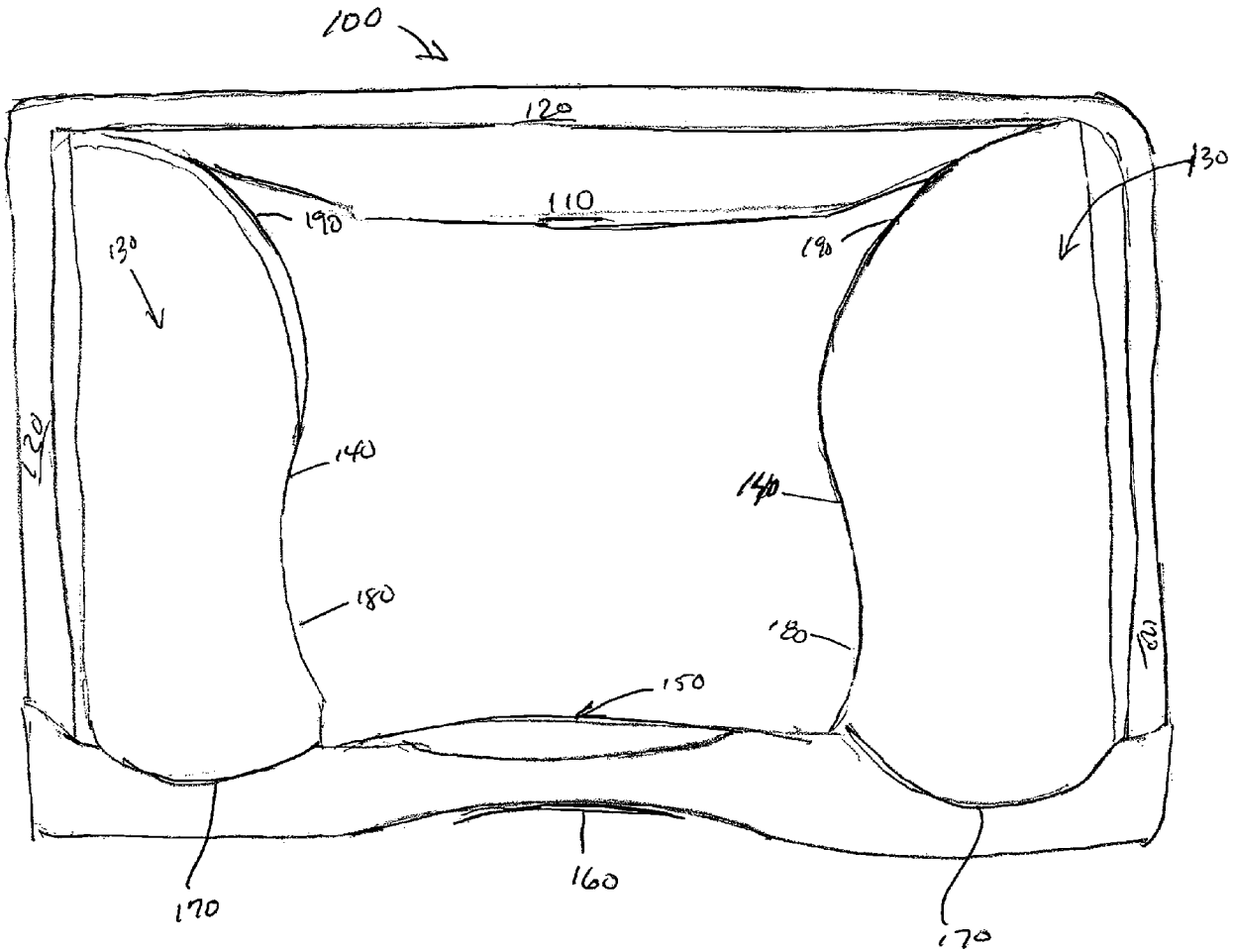
FIG. 1B shows a top perspective view of FIG. 1A without the user.
Figure 1C:
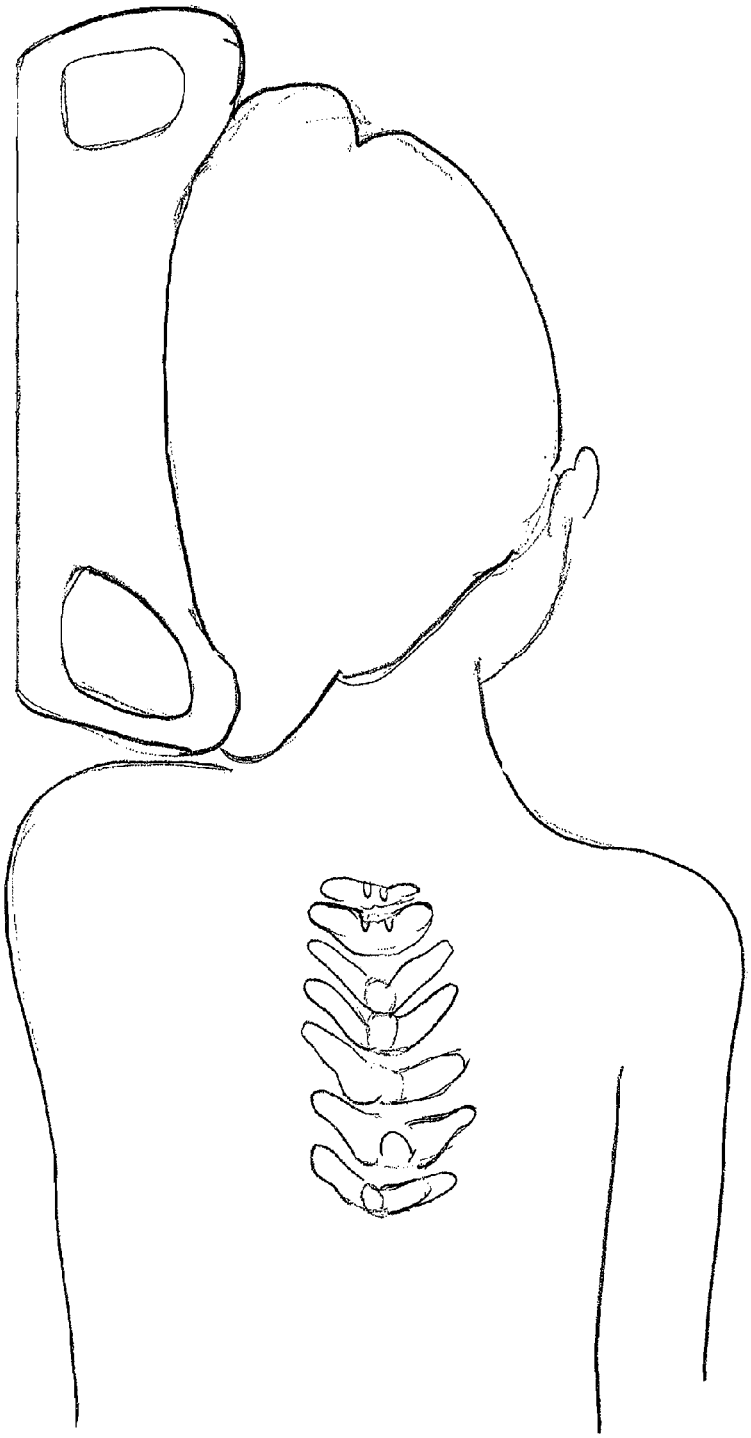
FIG. 1C PRIOR ART
FIG. 1C is a prior art therapeutic pillow.

Adverting in more detail to the drawings, FIG. 1A illustrates one embodiment of the invention. Shown is a therapeutic pillow 100. The pillow has a head rest portion 110, the head rest portion is inclined. Unlike typical orthopedic pillow that have an orthopedic core higher near the neck area than the head area as shown in FIG. 1C, the pillow of the present disclosure has a core lower at the neck portion and higher at the top of the head portion.

Support is given to the cervical area through an inclined neck portion 150 at a low end, and through the head rest area 110 at the high end. The neck portion 150 may be formed in an orthopedic like shape to provide neck support, however does not support the neck like other prior art pillows that do so by increased height of this neck section. Shoulder support also assists in correct cervical posture during the sleep cycle through hand rest groove 130 forcing correct posture of the shoulder area. Also as shown in FIG. 1B, shoulder region 160 also forces the user's shoulder into correct positioning. This shoulder area contains a curvature that forces a user into correct sleep positioning while sleeping in the lateral position. For sleep in the prone and supine positions, groove 130 contains a curvature 170 that assists in correct positioning of the user's hand and arm, thereby correcting positioning of the user's shoulder portion.

The hand rest portion or groove 130 also allows better positioning of the shoulder region and neck region for sleep and also provide support to the arm region to promote healing if the arm is injured. For example, user's with a broken arm or hand typically have difficulty steeping and positioning themselves during the sleep cycle. The present therapeutic pillow provides support to the injured area and allows a better sleeping pattern than conventional pillows for users with injured limbs.

A pillow support 120 encompasses the top portion of the pillow base. This support 120 provides added rigidity to the pillow and defines the boundaries of the head rest position. Groove 130 also contains a facial ridge 140 disposed above the groove. The facial ridge has several functions and benefits as previously described.

Groove 130 also defines curves 180 and curves 190 that provide for correct position of the users hand in groove 130. The user places the opposite hand farthest away from the bed into groove 130. This hand positioning also allows for correct shoulder and back alignment.

FIG. 2 illustrates this correct hand positioning in this exemplary illustration. Again it is noted that the user is not limited to the lateral position as shown but may utilize the disclosed therapeutic pillow in any sleeping position.

FIG. 3 illustrates the use of a therapeutic pillow 300 using only one groove 330. As illustrated, groove 330 is substantially parallel to side 360. the user places their head on head rest area 310. A neck portion 350 is included and includes the same features as previously described. Facial ridge 340 provides the user, as shown, with enough support to avoid facial tissue crushing by placing the user head on the pillow.

Groove 330 may be closed as illustrated with a substantial amount of space available above the user's hand for placement of a therapy center as previously described. Ridge 320 provides support and boundaries for the groove 330.

FIG. 4 illustrates a chin support 380 that supports a user's chin and further supports cervical alignment with the spine. Center section 370 is curved and inclined and can be used as a hand rest. Section 370 is lower from the top of the pillow where the head rest resides than the neck portion or pad 350.

Adverting to FIG. 5, shown is a pillow 500 with one embodiment of a therapy center. In this embodiment the therapy center is scented beads 516 placed in pouch 515. The therapy center can be many shapes and forms as previously described and is not limited to scented beads. In addition, the therapy center may be utilized in the pillow embodiment that has more than one hand rest area or groove 530. Head rest 510 is the same as previously described for other embodiments. Ridges 580 provides increased rigidity to the pillow and supports boundaries. It also prevents the therapy center from falling out of pillow 500. Center section 520 contains curvature 570 that provides for correct placement of the user's hand. Again, the user places in the lateral position, the hand farthest away from the bed into the groove area. This placement ensures correct body posture for the maximum health benefits.

Figure 6:
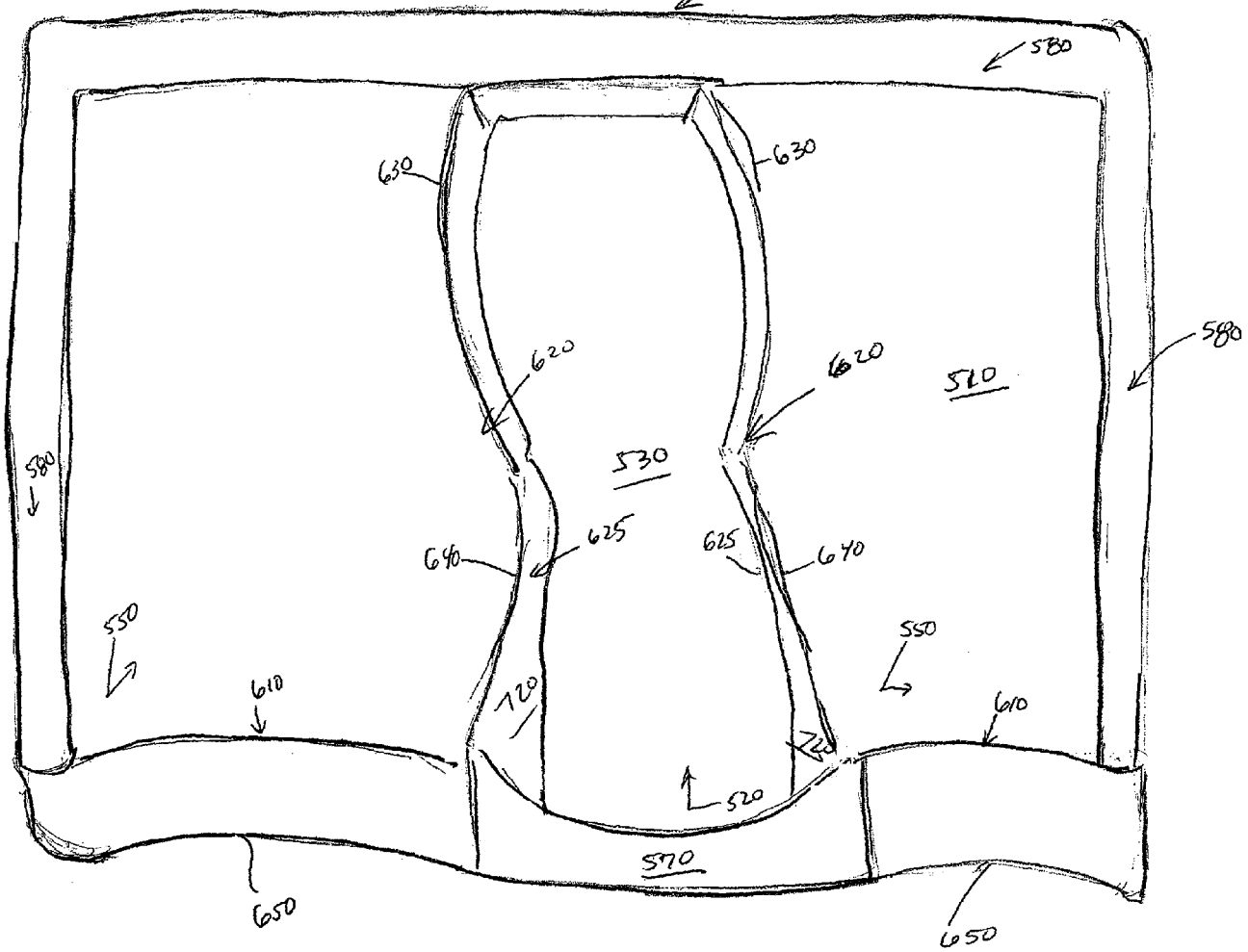
FIG. 6 shows a perspective front view of FIG. 5 without the user and slip cover and aroma therapy device.

FIG. 6 shows pillow 600 having shoulder sections 650. These shoulder sections provide support to the user's shoulders while the user is sleeping in the lateral positions. Neck section or pad 610 also provides further support to the user's cervical area. Facial ridge 620 is as previously described as is chin support 625. Upper curvatures 630 and lower curvatures 640 provide support for the hand and arm sections of the user.

Figure 7:
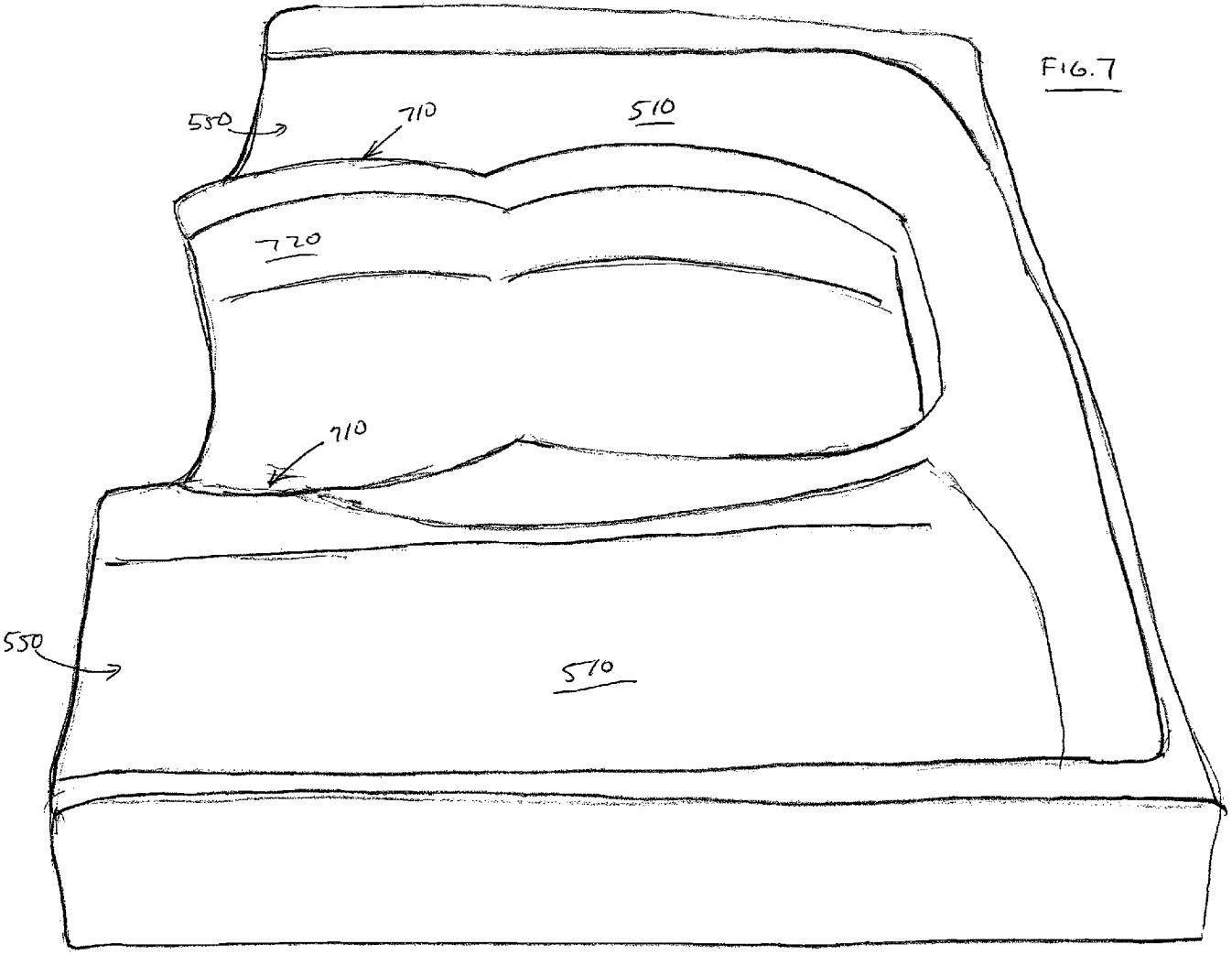
FIG. 7 shows a side perspective view of FIG. 6.
Figure 8:
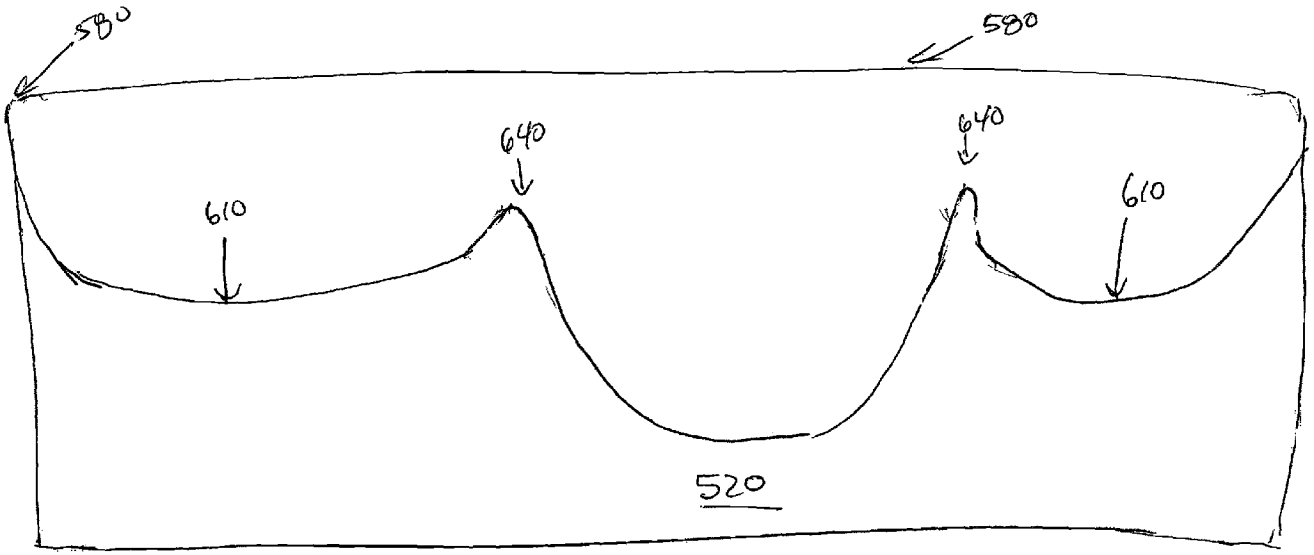
FIG. 8 shows a perspective front view of FIG. 7.

FIG. 8 illustrates one embodiment of a chin support area disposed above inclined section 720. Inclined section 720 provides for correct support of the user's hand, and is shown in FIGS. 6-7.

Illustrated in FIG. 8 is a front view of the embodiment in FIG. 7. Shown is the curvature 610 for the neck pad or portion area. Unlike prior art pillows with a flat or convex (bulges outward) section, the present therapeutic pillow has a concave surface (curves inward) to support the neck portion. Also shown is lower curvature 640 that forms the chin support and further distally the facial ridge.

Figure 9:
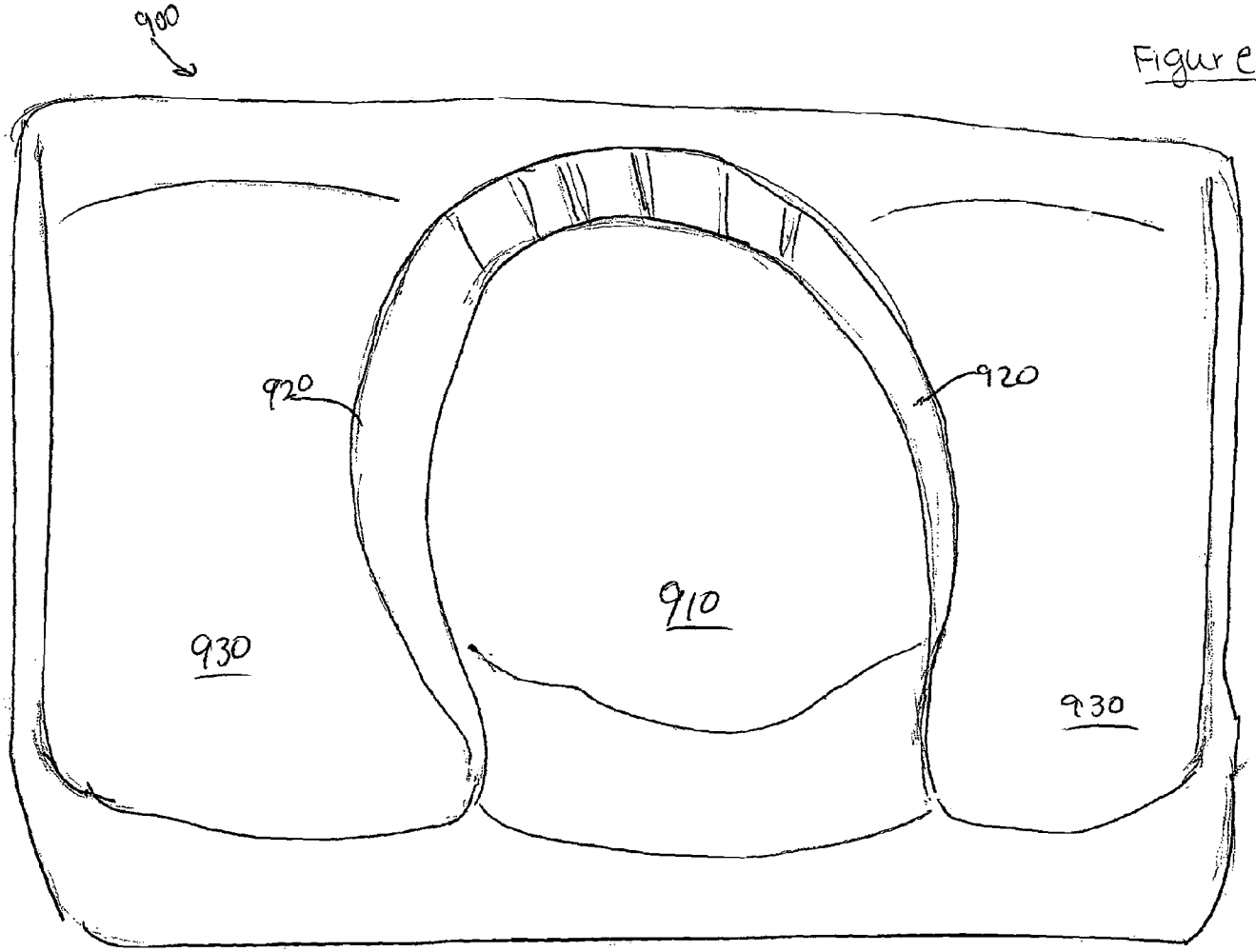
FIG. 9 shows a perspective view of another embodiment without the user, slip cover, and aroma therapy device.
Figure 10:
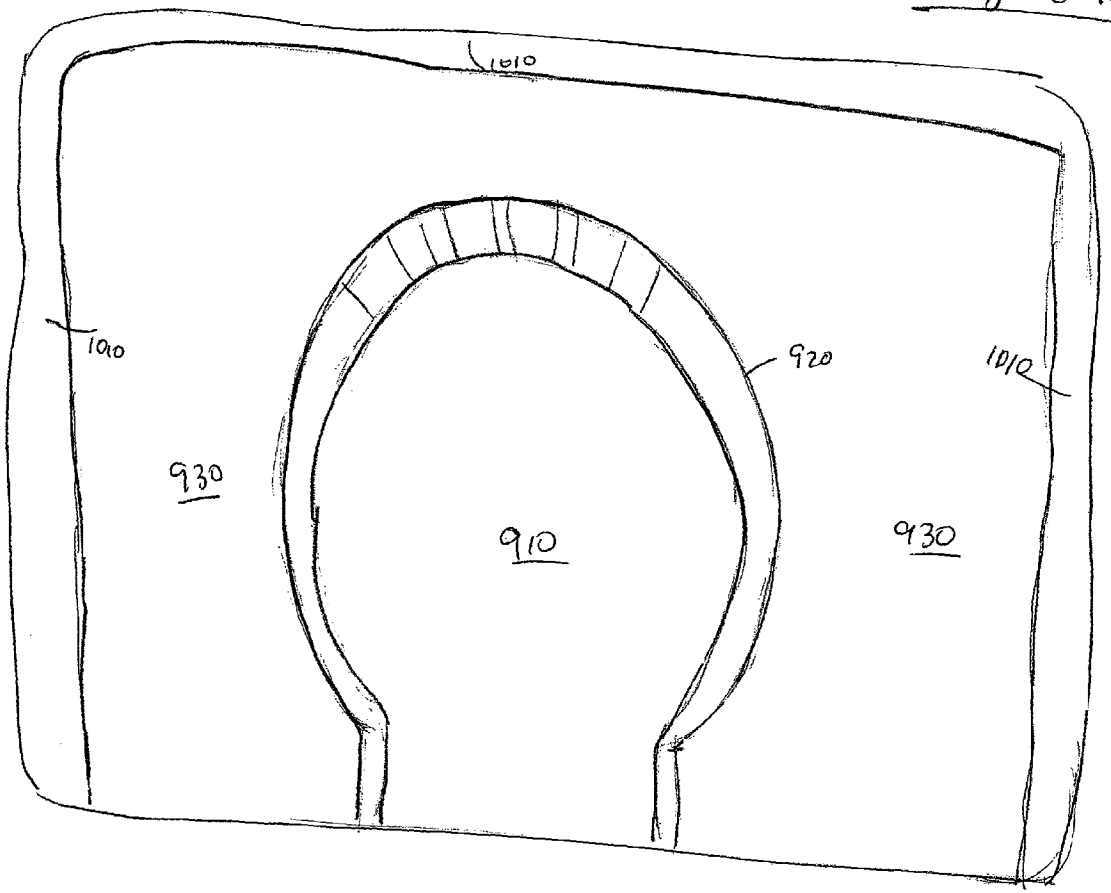
FIG. 10 shows a top view of FIG. 9.
Figure 11:
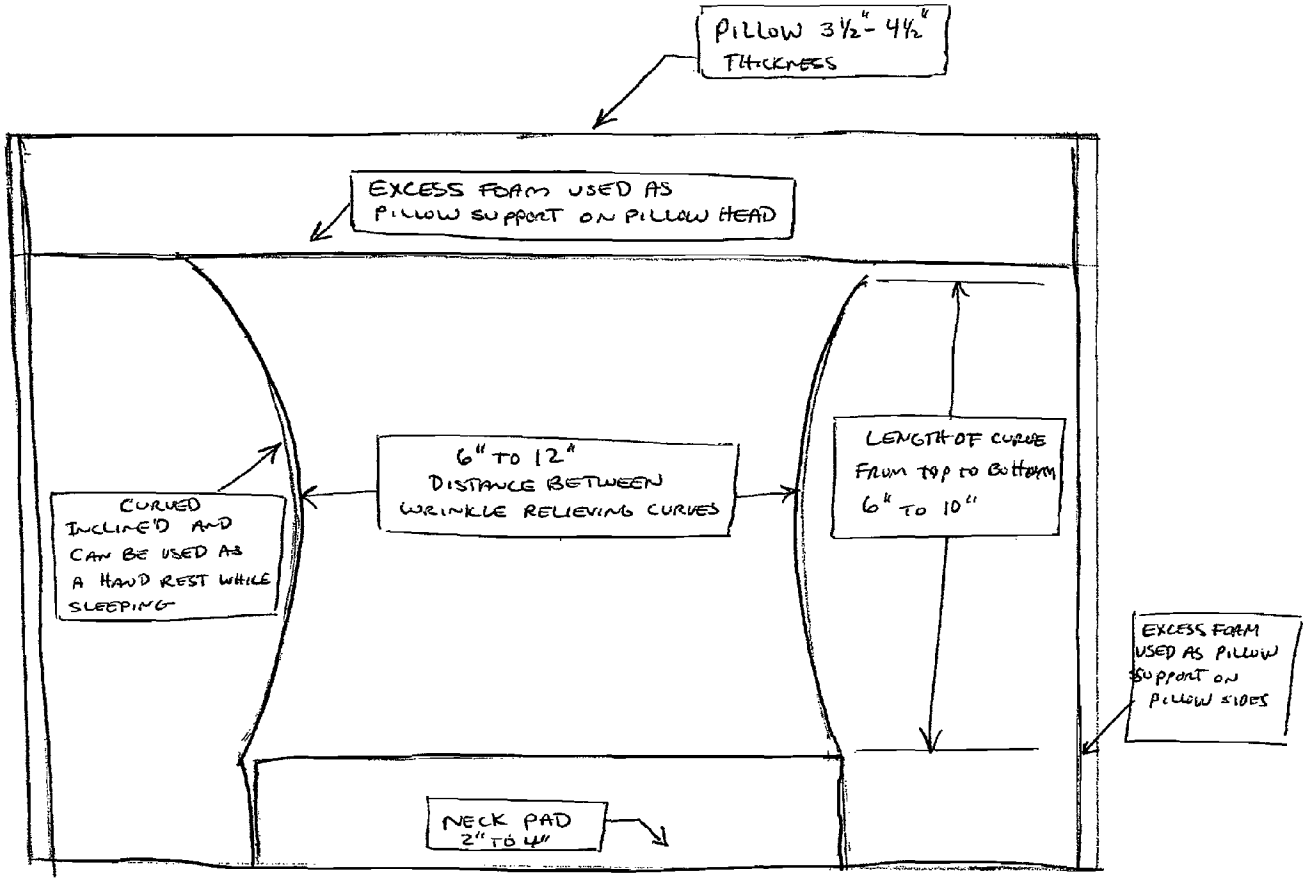
FIG. 11 shows a schematic drawing of one embodiment with a plurality of hand rests.
Figure 12A:
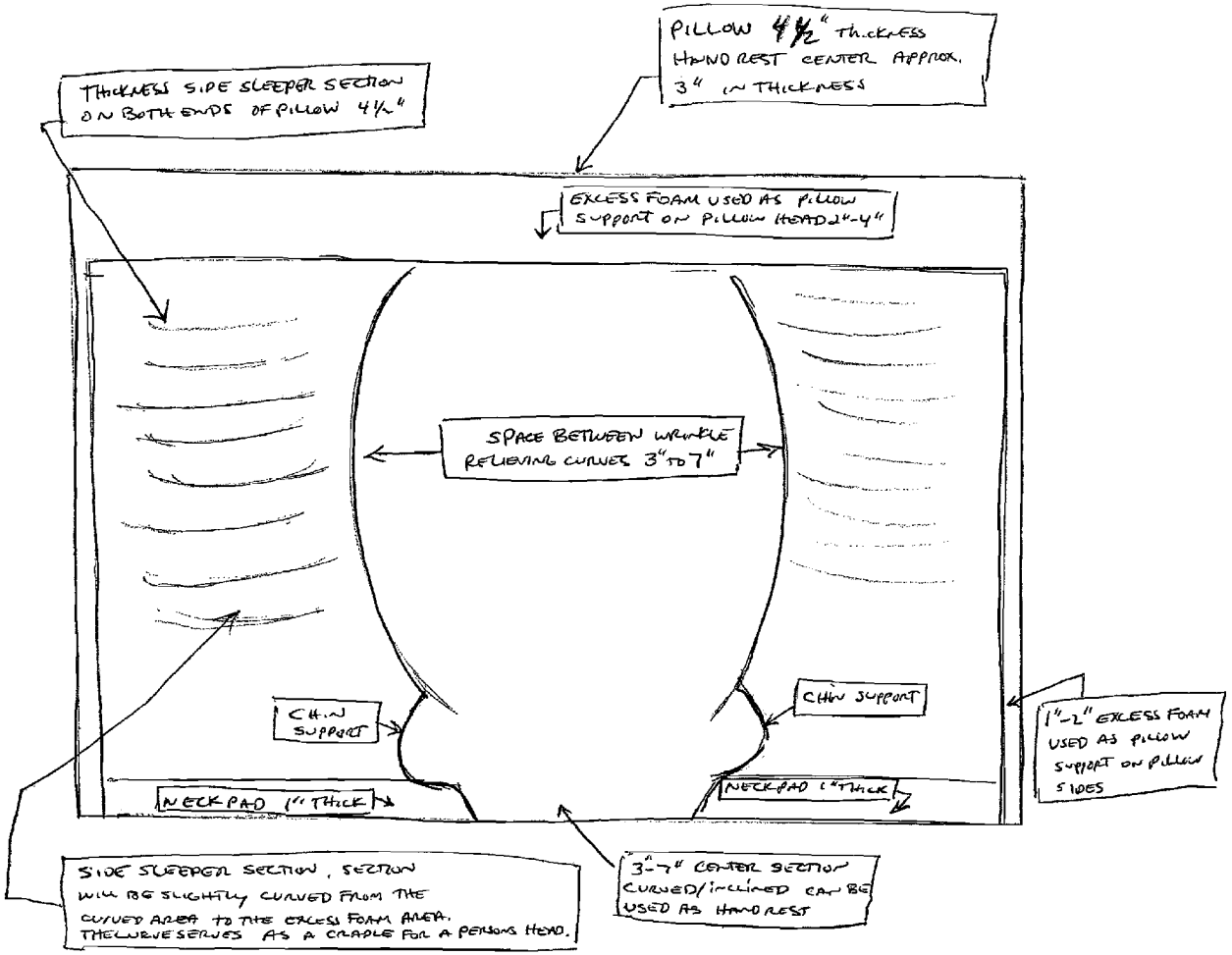
FIG. 12A shows a schematic drawing of another embodiment with one hand rest.
Figure 12B:
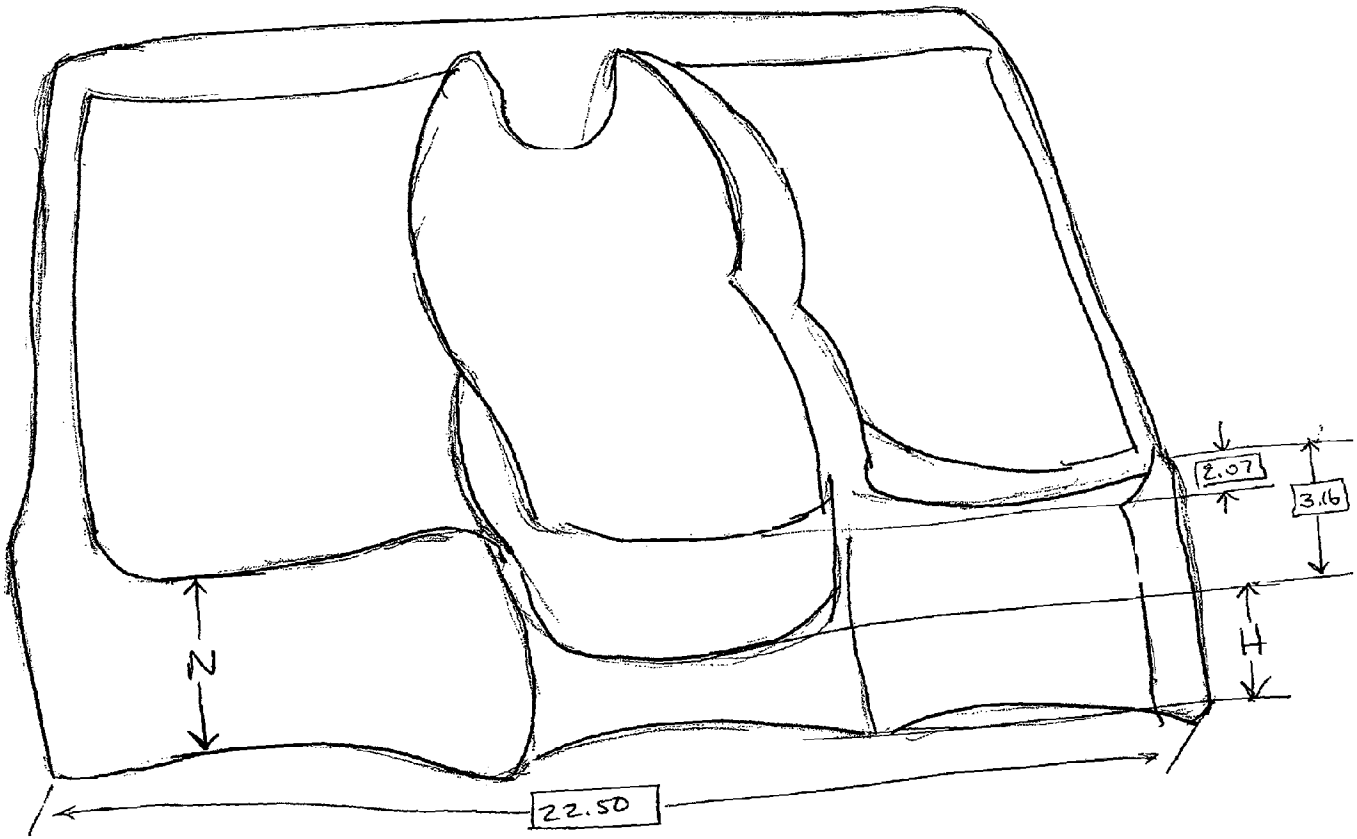
FIG. 12B shows a front view schematic drawing of another embodiment with one hand rest.
Figure 12C:
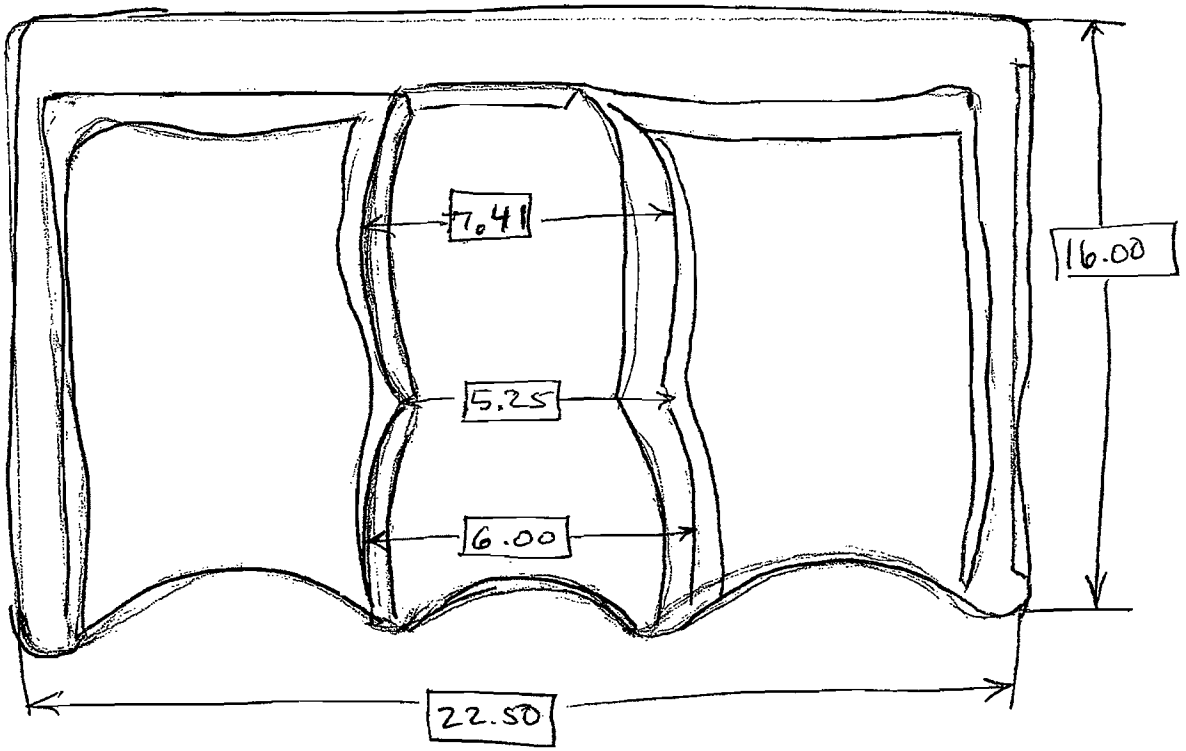
FIG. 12C shows a top view schematic drawing of another embodiment with one hand rest.
Figure 12D:
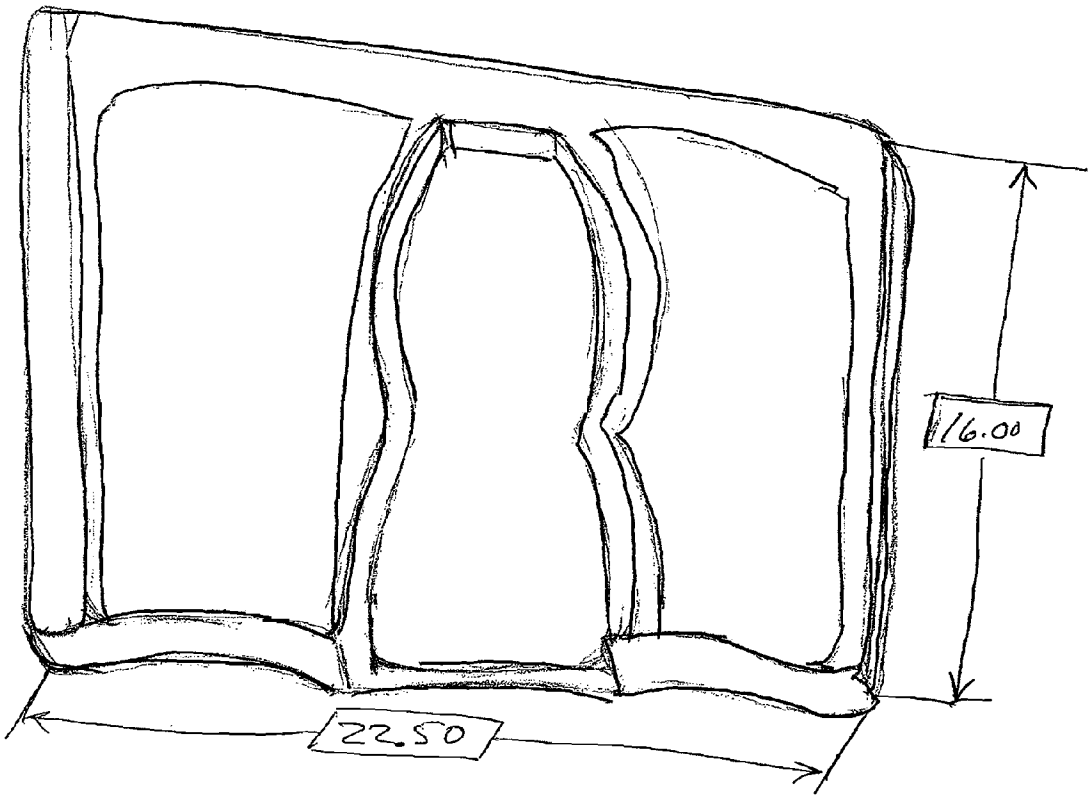
FIG. 12D shows a perspective view schematic drawing of another embodiment with one hand rest.

FIGS. 9-10 illustrate pillow 900. In this embodiment, the user's head is placed in head area 910. Hand rest areas 930 are disposed on either side of the head rest area. A facial ridge 920 is also included in pillow 900 and is disposed about the head rest area 910. Ridges 1010 provide support and additional rigidity for the pillow.

FIGS. 11 to 12A-12D illustrate examples of dimensional aspects of the therapeutic pillow. Shown are embodiments with hand rest grooves disposed on either side of the head rest and a hand rest groove disposed between multiple head rest areas. Of particular noteworthy dimensioned, the therapeutic pillow is dimensioned higher than a conventional pillow to facilitate alignment of the neck area while the user is in the lateral sleeping position. Dimension "N" as illustrated in FIG. 12B is typically higher than a conventional pillow. This dimension allows additional support to the cervical area of the user because the neck support is higher than a conventional pillow. In addition, dimension "H" for the arm support is dimensioned to support the hand and arm in a position such that the shoulder portion of the user is correctly positioned and aligned.

Other alternative embodiments or implementations according to the various teachings of the present invention will be understood by those skilled in the art and are achieved without departing from the spirit and scope of the invention. It is therefore intended that the present invention is not limited to the disclosed embodiments described herein but should be defined in accordance with the claims that follow.

I claim:

1. A therapeutic pillow, comprising:

a base having a top, a bottom, a left side, a right side, a front side, and a back side;

said top defining a left groove substantially parallel to the left side and a right groove substantially parallel to the right side, the left groove and the right groove each for providing support to a user's hand, maintaining a user's arm in alignment parallel with at least one of said left side or said right side, and providing positioning support to a user's shoulder portion;

a head rest portion on said top, the head rest portion having an ovular recess with an arcuately shaped, concave left surface and an arcuately shaped, concave right surface;

a left ridge and a right ridge disposed on said top for assistance in the prevention against definition face lines or wrinkles while using the pillow, at least a portion of the left ridge curving inwards towards the right ridge so to define a convex right surface of the left groove and the arcuately shaped, concave left surface of the head rest portion, and at least a portion of the right ridge curving inwards towards the left ridge so to define a convex left surface of the right groove and the arcuately shaped, concave right surface of the head rest portion; and a neck pad portion disposed on said top at an inclined angle for preventing misalignment of the user's cervix and spine.

2. The pillow of claim 1 further includes a therapy center disposed about at least one of said left groove or said right groove.

3. The pillow of claim 2, wherein the therapy center includes at least one of the following: scented beads, potpourri, incense, light therapy, sound therapy, vibration therapy, motion therapy, or any combination thereof.

4. The pillow of claim 1, wherein said bottom side includes a curvature for placement of a user's shoulder portion.

5. The pillow of claim 1 wherein at least one of said left groove or said right groove is formed with multiple curvatures to support a user's hand and arm for promotion of healing and support to a user's shoulder for proper positioning during a sleep cycle.

6. The pillow of claim 5, wherein at least one of said left groove or said right groove has an inclined portion.

7. The pillow of claim 1, wherein said base is made of a memory foam material.

8. The pillow of claim 1, further including a head rest area disposed on said top, said head rest area being formed with a depression having a lower portion closest to a user's shoulder.

9. A pillow comprising:

a base having a top, a bottom, a left side, a right side, a front side, and a back side;

said top having a head rest portion having an ovular recess with an arcuately shaped, concave left surface and an arcuately shaped, concave right surface, a left hand rest area including a left groove, and a right hand rest area including a right groove, said left groove and said right groove each providing support to a user's hand, maintaining a user's arm in alignment with at least one of said left side or said right side; and a left ridge and a right ridge disposed on said top, at least a portion of the left ridge curving inwards towards the right ridge so to define a convex right surface of the left groove and the arcuately shaped, concave left surface of the head rest portion, and at least a portion of the right ridge curving inwards towards the left ridge so to define a convex left surface of the right groove and the arcuately shaped, concave right surface of the head rest portion.

10. The pillow of claim 9, further including a chin support.

11. The pillow of claim 9, further including an inclined hand portion disposed at least at one end of said left hand rest are or said right hand rest area for entry of a user's hand.

* * * * *